US008373101B2

(12) United States Patent
Seguchi et al.

(10) Patent No.: US 8,373,101 B2
(45) Date of Patent: Feb. 12, 2013

(54) INDUCTION HEATING DEVICE WITH ORTHOGONAL COILS

(75) Inventors: Kazumi Seguchi, Saga (JP); Yasuhiro Torigoe, Saga (JP); Shinichirou Date, Saga (JP)

(73) Assignee: Panasonic Corporation, Osaka (JP)

( * ) Notice: Subject to any disclaimer, the term of this patent is extended or adjusted under 35 U.S.C. 154(b) by 274 days.

(21) Appl. No.: 12/778,402

(22) Filed: May 12, 2010

(65) Prior Publication Data

US 2010/0288753 A1 Nov. 18, 2010

(30) Foreign Application Priority Data

May 18, 2009 (JP) ..... 2009-119526
Sep. 15, 2009 (JP) ..... 2009-212596

(51) Int. Cl.
*H05B 6/14* (2006.01)

(52) U.S. Cl. ..... 219/619; 219/216

(58) Field of Classification Search ..... 219/216, 219/619

See application file for complete search history.

(56) References Cited

U.S. PATENT DOCUMENTS

| | | | | |
|---|---|---|---|---|
| 6,795,679 | B2 | 9/2004 | Shimizu et al. | |
| 2003/0147679 | A1 | 8/2003 | Shimizu et al. | |
| 2004/0226940 | A1 | 11/2004 | Monda et al. | |
| 2004/0238530 | A1 | 12/2004 | Nonaka et al. | |
| 2004/0240898 | A1 | 12/2004 | Nonaka et al. | |
| 2005/0031365 | A1 * | 2/2005 | Takagi et al. | 399/69 |
| 2005/0169659 | A1 * | 8/2005 | Koyama et al. | 399/88 |
| 2007/0108191 | A1 * | 5/2007 | Takagi et al. | 219/619 |
| 2007/0201914 | A1 * | 8/2007 | Tsuji et al. | 399/328 |
| 2007/0212091 | A1 * | 9/2007 | Kinouchi et al. | 399/69 |
| 2008/0063443 | A1 * | 3/2008 | Yoshinaga et al. | 399/328 |

FOREIGN PATENT DOCUMENTS

| | | |
|---|---|---|
| JP | 2002-341692 | 11/2002 |
| JP | 2003-223063 | 8/2003 |

* cited by examiner

*Primary Examiner* — Fernando L Toledo
*Assistant Examiner* — Peter Bradford
(74) *Attorney, Agent, or Firm* — Greenblum & Bernstein, P.L.C.

(57) ABSTRACT

There are provided a first excitation coil that is wound so as to have an axis in the same direction as that of a shaft of a heating roller and that is connected to a first power source, and a second excitation coil that is wound so as to have an axis in a direction substantially orthogonal to the shaft of the heating roller and that is connected to a second power source. The second excitation coil has parallel portions that extend in parallel to an axial direction of the first excitation coil and two folded sections provided at respective ends of the parallel portions. The two folded sections are provided along a circumference of the first excitation coil in such a way that circular arcs of the respective folded sections become opposite in direction to each other. Thus, the maximum available power is increased. When rapid warm-up is required, heating is caused by a coil connected to the auxiliary power source, to thus shorten a warm-up time. Occurrence of a temperature drop at the ends of the heating roller is prevented, to thus enhance energy efficiency. In ordinary situations other than the rapid warm-up operation, recharging can be performed by use of the coil.

6 Claims, 15 Drawing Sheets

INDUCTION HEATING DEVICE WITH ORTHOGONAL COILS

BACKGROUND

1. Field of the Invention

The present invention relates to an induction heating device that is employed in a fuser of an image forming apparatus which thermally fixes onto a recording sheet a toner image produced thereon and that adopts particularly an electromagnetic induction technique (an IH technique) as a heating technique.

2. Description of the Related Art

A market demand for energy conservation and increasing speed of an image forming apparatus, such as a printer, a copier, and a facsimile, is recently growing. In order to fulfill these required performances, improvements in thermal efficiency of a fuser used in the image forming apparatus are important.

As described in (JP-A-2003-223063) and the like, a technique for generating Joule heat from an eddy current, which has developed in a magnetic metal component from an alternating field, and heating an element to be heated including a metal material by means of electromagnetic induction heating has already been proposed as a fuser of electromagnetic induction heating type.

In relation to the fuser of electromagnetic induction heating type, a fuser of electromagnetic induction heating type equipped with two excitation coils whose magnetic fluxes differ in direction from each other at an angle of 90° has also been proposed (JP-A-2002-341692).

Incidentally, increasing speedup of an image forming apparatus has recently been demanded, and shortening of a heating time of a fuser is sought.

However, a current value that a single system of power line can supply to one image forming apparatus is limited up to; for instance, 15 A. A conceivable method for increasing the heating speed of the fuser is to temporarily supply a large amount of electric power from the power line. However, when a commercial power source is used, the limitation makes it impossible to supply electric power of 15 A or more from the commercial power source. Accordingly, means that can temporarily supply a large amount of electric power to the image forming apparatus while avoiding supply of an overcurrent of 15 A or more from the power line is required. However, means involving laborious operation is awkward to use.

Moreover, it is desirable that a heating roller of a fuser will exhibit a uniform temperature distribution in an axial direction. However, the heating temperature declines in the vicinity of two axial ends of the heating roller. The fuser of electromagnetic induction heating type is subjected to dissipation of heat to the ambient air, and also requires a bridge area to be disposed at each end for changing a winding direction of an excitation coil to an opposite direction. A temperature fall also arises in the bridge areas. The reason for this is that, in the bridge area, a curvature radius of winding of a coil varies from one winding to another between an inner radius and an outer radius and that magnetic fluxes are not generated in a constant direction. Therefore, flux density of the windings in the bridge area becomes smaller than flux density of windings in an area other than the bridge area. As a result, a heating temperature decreases, which in turn hinders exhibition of a uniform temperature distribution in the axial direction.

SUMMARY

The present invention aims at providing an induction heating device that can shorten a warm-up time by effecting heating through use of an auxiliary coil when a rapid temperature increase is required.

In order to solve the problem, an induction heating device of the present invention is characterized by comprising: a cylindrical heating roller that performs electromagnetic induction heating; a first excitation coil that is provided inside of the heating roller, that is wound so as to have an axis in the same direction as that of a shaft of a heating roller, and that is connected to a first power source; and a second excitation coil that is provided inside of the heating roller, that is wound so as to have an axis in a direction substantially orthogonal to the shaft of the heating roller, and that is connected to a second power source, wherein the second excitation coil has parallel portions that extend in parallel to an axial direction of the first excitation coil and two bridge areas folded at respective ends of the parallel portions; and the two bridge areas are provided along a circumference of the first excitation coil in such a way that directions of circular arcs of the respective bridge areas become opposite each other.

DETAILED DESCRIPTIONS

First Embodiment

A first embodiment of the present invention will hereinbelow be described by referenced to the drawings.

Figure 1:
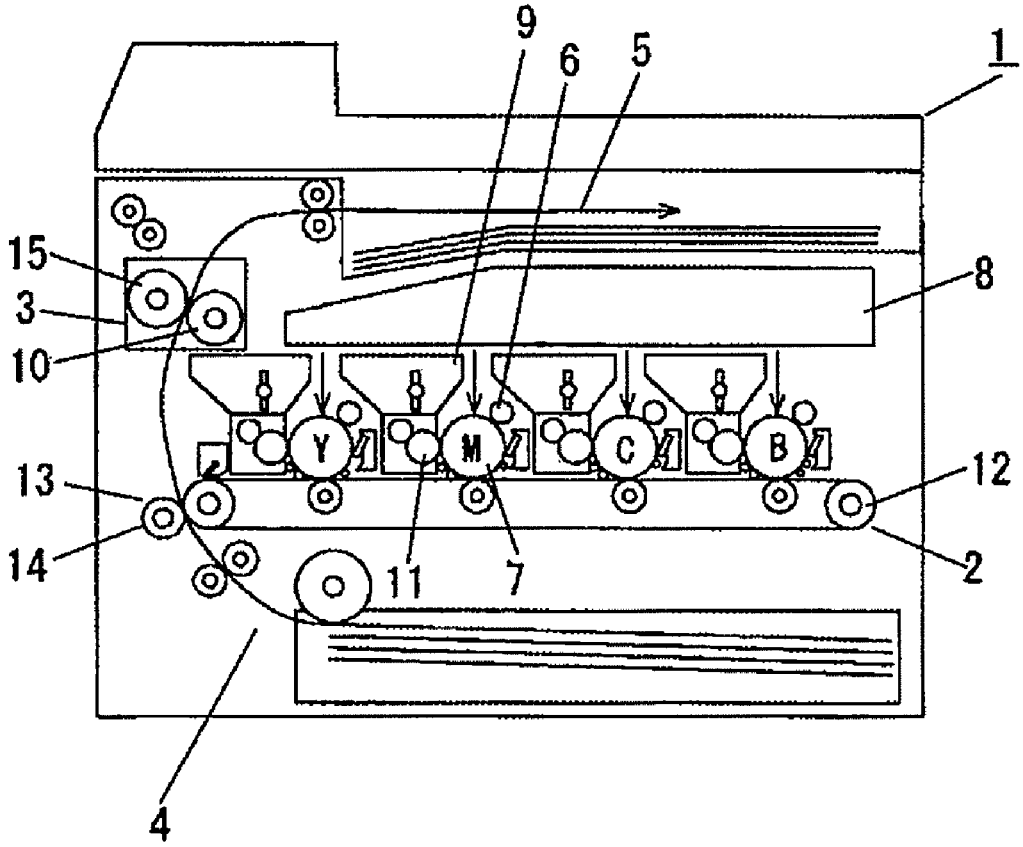
FIG. 1 is a block diagram of a copier to which an induction heating device of the present invention is applied as a fuser.

FIG. 1 is a block diagram of a copier to which an induction heating device of the present invention is applied as a fuser. The copier (an image forming apparatus) shown in FIG. 1 is a tandem color image forming apparatus and has a document reading section 1 that reads an image of a document; an image forming section 2 that produces the thus-read image of the document as an image on each of photosensitive drums 7, produces toner images by means of toner, and further transfers the toner images on a recording sheet (that is generally an image forming medium); and a fuser 3 that fixes the toner images onto the recording sheet. A sheet feeding section 4 feeds a recording sheet to the image forming section 2, and the recording sheet having finished undergoing fusing processing in the fuser 3 is output to a sheet output section 5.

In the image forming section 2, the photosensitive drums 7 uniformly electrified by corresponding electrifiers 6 are irradiated with laser beams emitted from an LSU (Laser Scanning Unit) 8, whereupon electrostatic latent images are produced on surfaces of photosensitive layers of the respective photosensitive drums 7. Subsequently, toner in respective developing units 9 is supplied to the respective photosensitive drums 7 by way of respective developing rollers 11, to thus develop the respective electrostatic latent images. Yellow (Y), magenta (M), cyan (C), and black (K) photosensitive drums 7 are arranged along an intermediate transfer belt 12. Toner images are produced from the respective electrostatic latent images by means of the toner supplied from the respective colors of developing rollers 11. The toner images are sequentially transferred to the intermediate transfer belt 12 through primary transfer operation. The toner images produced as a result of the respective colors of toner layers being stacked on the intermediate transfer belt 12 are transferred onto the recording sheet by means of a transfer roller 14 of a transfer unit 13 through secondary transfer operation.

Figure 2:
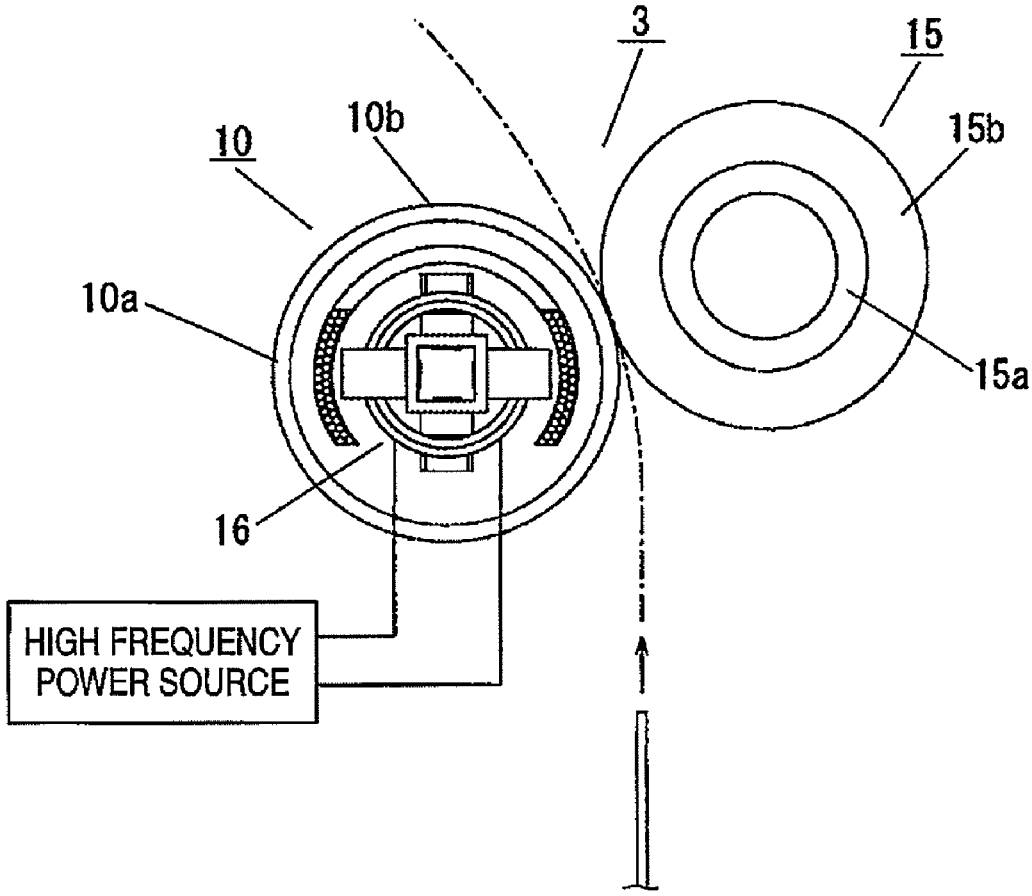
FIG. 2 is a cross-sectional view of the fuser shown in FIG. 1 to which the induction heating device of the present invention is applied.

FIG. 2 is a cross-sectional view of the fuser 3 shown in FIG. 1 to which the induction heating device of the present invention is applied. As shown in FIG. 2, the fuser 3 is comprised of a cylindrical heating roller 10 that fuses a toner image on a recoding sheet (an image forming medium) by means of electromagnetic induction heating and a press roller 15 that is forcefully driven so as to make press contact with the heating roller 10. When the recording sheet subjected to secondary transfer is transported to a nipping area between the heating roller 10 and the press roller 15, the toner on the recording sheet is fused by heat and pressure exerted in the nipping area, whereupon the toner on the recording sheet is thermally fixed.

In the descriptions of the first embodiment, an explanation is given to a structure for bringing the press roller 15 into direct, press contact with the heating roller 10. However, the same also basically applies to a structure using a heating belt whose heat capacity is smaller than heat capacity of the roller. In this case, an endless heating belt is passed between a heating roller and a fixing roller. A recording sheet is caused to pass between the press roller disposed opposite the fixing roller and the heating belt to be moved, whereby toner on the recording sheet is fixed on the recording sheet by actions of heat and pressure.

As shown in FIG. 2, the heating roller 10 has a heating roller body 10*a* made of a magnetic metal material, such as stainless steel, and a surface of the heating roller body 10*a* is coated with a mold release layer 10*b* made of a fluorine resin, and the like. An induction heating device 16 is built in the heating roller body 10*a*, and the heating roller body 10*a* is heated by the induction heating device 16.

A heating structure of the heating roller 10 is now described. The induction heating device 16 having an LC resonance circuit consisting of an excitation coil and a capacitor is accommodated in the heating roller 10. The LC resonance circuit generates a high frequency alternating field. The structure and action of the LC resonance circuit will later be described in detail. When magnetic fluxes developing along the thus-generated magnetic field cross the heating roller body 10*a* of the heating roller 10, an eddy current develops in the heating roller body 10*a*. The heating roller 10 is heated by Joule heat caused by the eddy current and the resistance of the heating roller 10, to thus become possible to thermally fix the toner image on the recording sheet.

In contrast, the press roller 15 is made up of a cored bar 15*a* made of an aluminum alloy and an elastic layer 15*b* that is provided around the cored bar 15*a* and made of silicone rubber foam, and the like.

Figure 3:
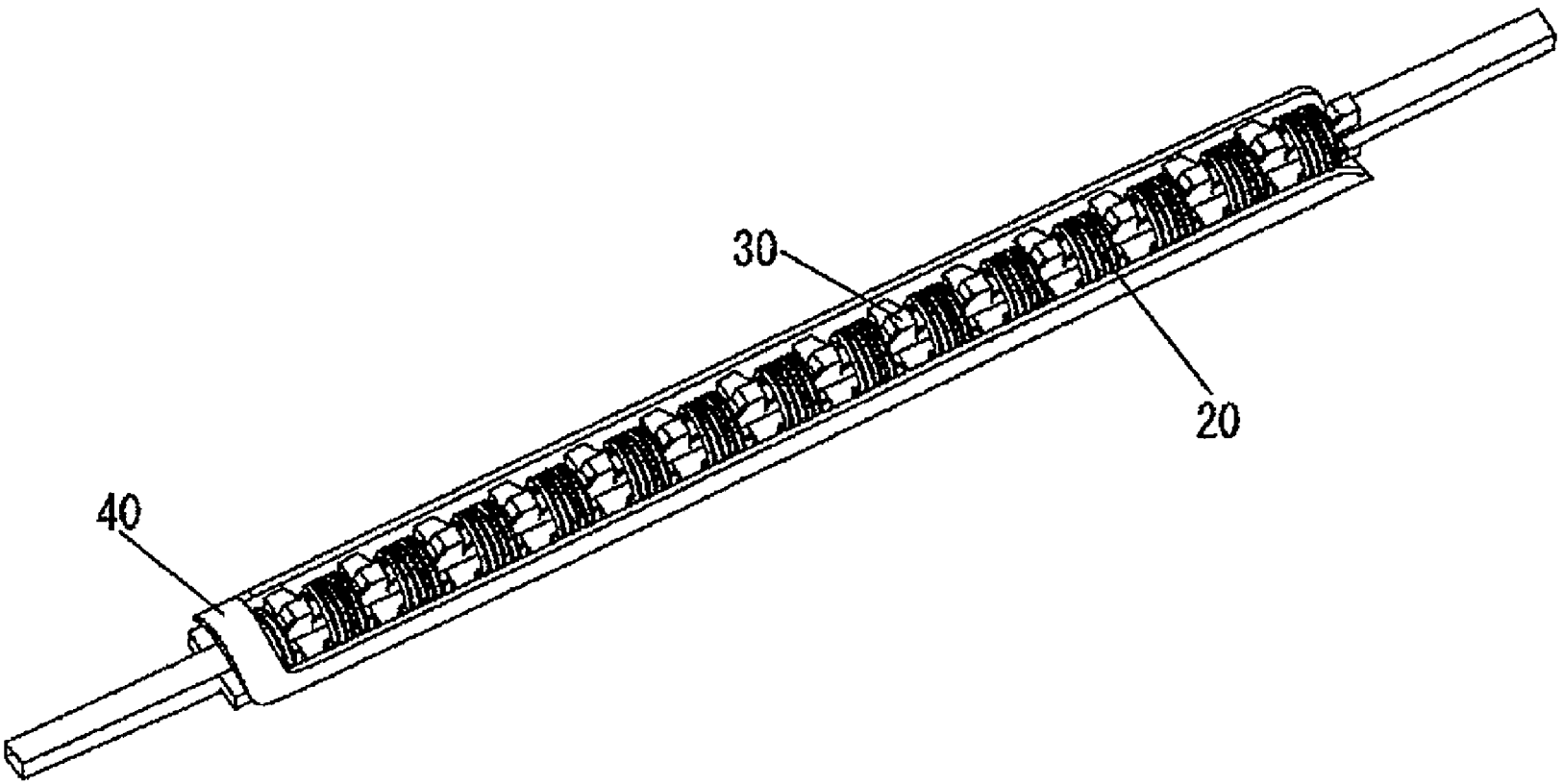
FIG. 3 is a general perspective view of coil unit making up the induction heating device of the first embodiment of the present invention.
Figure 4:
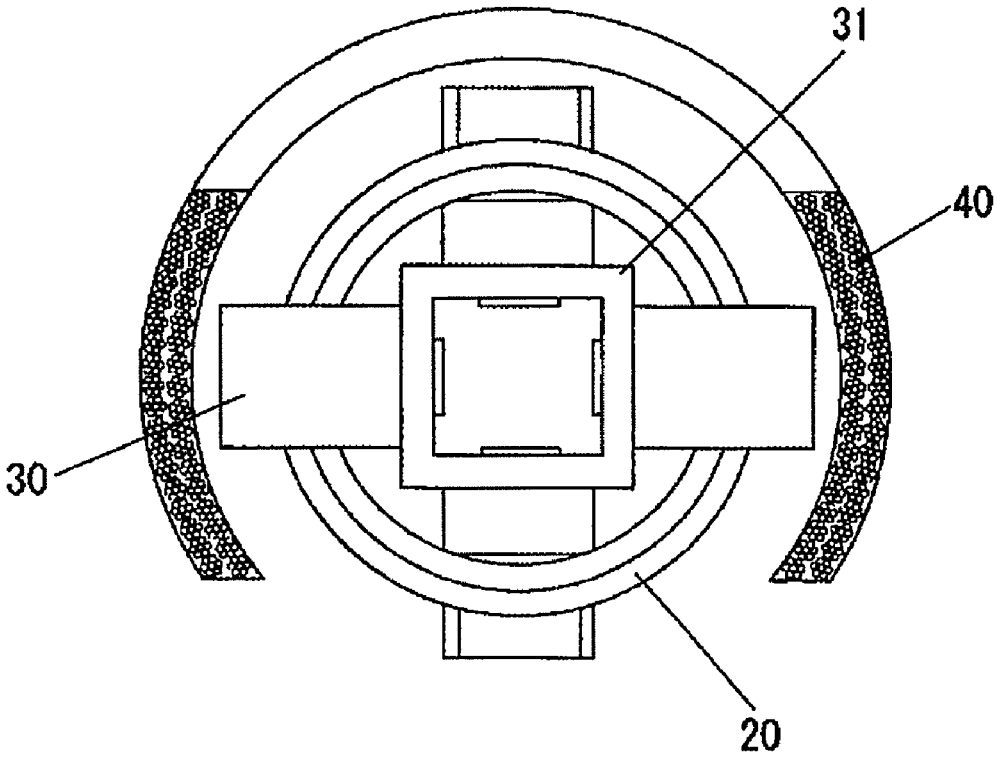
FIG. 4 is a cross-sectional view of a coil unit making up the induction heating device of the first embodiment of the present invention.

FIG. 3 is a general perspective view of coil unit making up the induction heating device of the first embodiment of the present invention; and FIG. 4 is a cross-sectional view of a coil unit making up the induction heating device of the first embodiment of the present invention, showing the configuration of the principal section of the induction heating device accommodated in the heating roller 10 described by reference to FIG. 2. In FIGS. 3 and 4, reference numeral 20 designates a first excitation coil that is coiled so as to have an axis in the same direction where an axis of the heating roller 10 extends and that is connected to a commercial power source; 30 designates ferrite cores; 31 designates a holding member on which the ferrite cores 30 are disposed; and 40 designates a second excitation coil that is positioned within the heating roller 10, coiled so as to have an axis in a direction substantially perpendicular to the axis of the heating roller 10, and connected to an auxiliary power source. The first excitation coil 20 is wound around the axis of the heating roller 10 along grooves of the ferrite cores 30, each of which has a substantially-C-shaped cross-sectional profile. The holding member 31 is made of a nonmagnetic resin and serves as a core material shown in FIG. 4.

Figure 5:
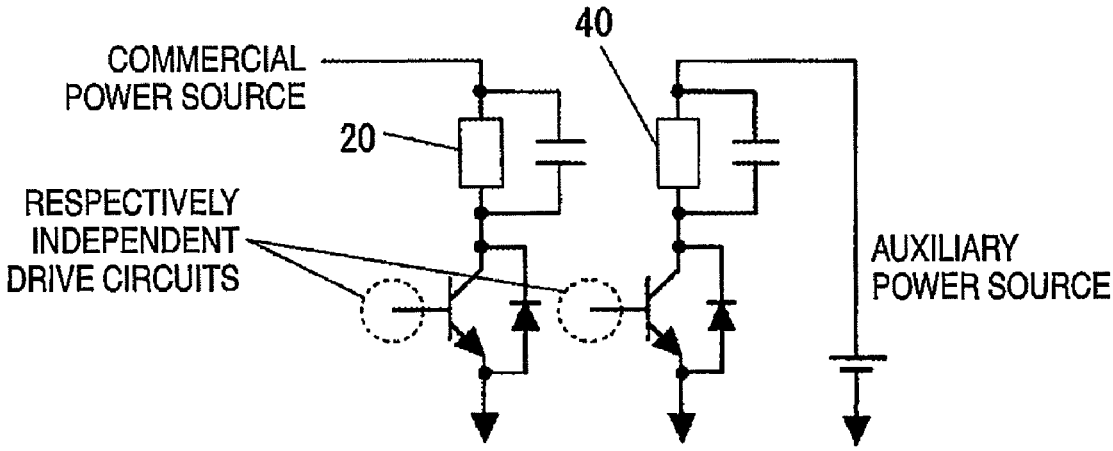
FIG. 5 is a general schematic circuit diagram of the coil unit making up the induction heating device of the first embodiment of the present invention.

FIG. 5 is a general schematic circuit diagram of the coil unit making up the induction heating device of the first embodiment of the present invention. The principal section of a control circuit of the coil unit made up of the first excitation coil 20, the second excitation coil 40, and the ferrite cores 30 will briefly be described. As shown in FIG. 5, the first excitation coil 20 and the second excitation coil 40 are connected to respective independent drive circuits, and the respective drive circuits are connected to respective switching elements. The switching elements control a duty ratio used for controlling a calorific value (hereinafter called "duty control"). The first excitation coil 20 is supplied with an electric current from a commercial power source (a "first power source" of the present invention), and the second excitation coil 40 is supplied with an electric current from an auxiliary power source (a "second power source" of the present invention).

When the first excitation coil 20 is supplied with an electric current from the commercial power source, an alternating field develops around the first excitation coil 20, because the first excitation coil makes up the LC resonance circuit, whereupon magnetic fluxes commensurate with the amount of electric current are generated by duty control of the control circuit. Both the first excitation coil 20 and the second excitation coil 40 are made by winding a conductor wire, and a litz wire made by tying a plurality of insulated copper wires into bundles is used for the conductor wire. The ferrite cores 30 are provided for maintaining the magnetic fluxes around the first excitation coil 20 (i.e., for enhancing flux density) so as to prevent divergence of the thus-developed magnetic fluxes.

As can be seen from FIG. 3, the second excitation coil 40 of the first embodiment is a coil formed so as to cover the first excitation coil 20 and the ferrite cores 30 from the outside. As shown in FIGS. 3, 4, 7A, 13, and 14, the second excitation coil 40 is wound in a direction substantially orthogonal to the direction of the axis of the first excitation coil 20. Therefore, magnetic fluxes developing from the second excitation coil 40 and magnetic fluxes developing from the first excitation coil 20 intersect at right angles (see FIGS. 13 and 14). The reason why the coil is wound in a substantially orthogonal direction is because the conductor wire is wound at a predetermined pitch and because the coil is inevitably inclined to at least an angle corresponding to a winding pitch that is equivalent of the thickness of the wire. A first bridge area 41 and a second bridge area 42 provided at both ends of the second excitation coil 40 are bent at both ends of the heating roller 10 so as to assume circular-arc shapes in mutually opposite vertical directions (see FIG. 8A).

The ferrite cores 30 shown in FIGS. 2 and 4 are members that each assume a substantially-C-shaped cross-sectional profile and that is made of a material exhibiting ferromagnetism; and that are placed adjacently to respective faces of a holding member 31 with their openings oriented in radial directions toward the heating roller 10. Therefore, the ferrite cores are regularly arranged along an axis and around a four-row heating roller 10 at a pitch of 90° in the winding direction of the first excitation coil 20.

Each of the ferrite cores 30 has a base extending along an interior periphery of the first excitation coil 20 and a pair of bent portions (radial portions) extending closely toward an interior periphery of the heating roller body 10*a*. Accordingly, magnetic fluxes developing from the first excitation coil 20 wound around the bases of the respective ferrite cores 30 are guided by the bent portions from the bases of the ferrite cores 30 in radial directions, to thus leak from the ends of the bent portions in directions crossing the heating roller body 10*a*, and again enter the ends of the bent portions of the ferrite cores 30 from their radial directions by way of the heating roller body 10*a*. Since the magnetic fluxes do not well pass through an air exhibiting low permeability, the magnetic fluxes are concentrated on areas made of magnetic substance, such as the ferrite cores 30 and the heating roller body 10*a*. An eddy current is generated by magnetic fluxes developing from the heating roller body 10*a*, whereupon the heating roller 10 is heated.

Figure 6:
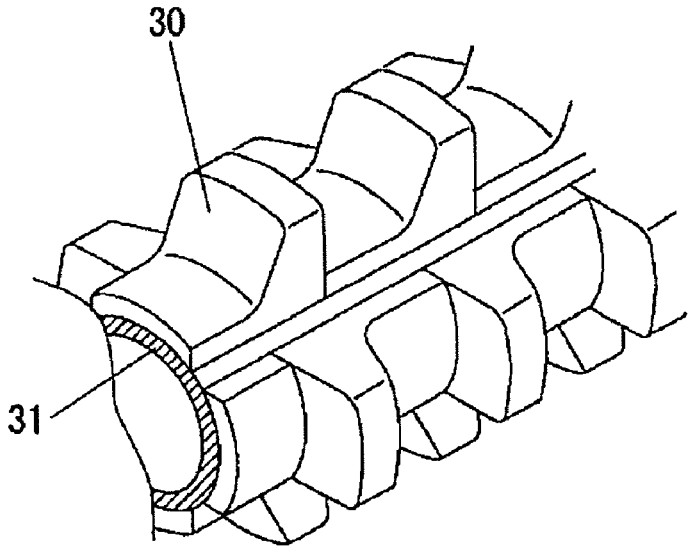
FIG. 6 is a partially-fragmented perspective view of the induction heating device of the first embodiment of the present invention acquired when ferrite cores, each of which has a substantially-L-shaped cross-sectional profile, are placed on the holding member.

Incidentally, it is also desirable to realize each of the ferrite cores 30 as a component having a substantially-L-shaped cross-sectional profile, such as that shown in FIG. 6, rather than the substantially-C-shaped cross-sectional profile; and besides it is desirable to form the holding member 31 from a cylindrical core material. FIG. 6 is a partially-fragmented perspective view of the induction heating device of the first embodiment of the present invention acquired when ferrite cores, each of which has a substantially-L-shaped cross-sectional profile, are placed on the holding member. As shown in FIG. 6, the bases are axially arranged in the form of four rows along peripheral directions of the surface of the cylindrical holding member 31. In each row, the orientation of a sequence of L-shaped ferrite cores is unified, and the ferrite cores are aligned in one direction, thereby accomplishing an arrangement in which the orientation of the L-shaped ferrite cores is inverted at intervals of 90° in the circumferential direction. Each of the ferrite cores is provided with an L-shaped form, and the ferrite cores are alternately arranged while inverted, whereby the shape of the ferrite cores can be simplified, and the quantity of material for the components can also be reduced. Magnetic fluxes generated by the first excitation coil 20 are guided to L-shaped bent portions (radial portions) of the ferrite cores 30; leak from ends of the bent portions; and again enter other bent portions (radial portions) of other ferrite cores 30 from the radial directions by way of the heating roller body 10*a*. The cylindrical holding member 31 is a resin core material that is a nonmagnetic substance.

Figure 13:
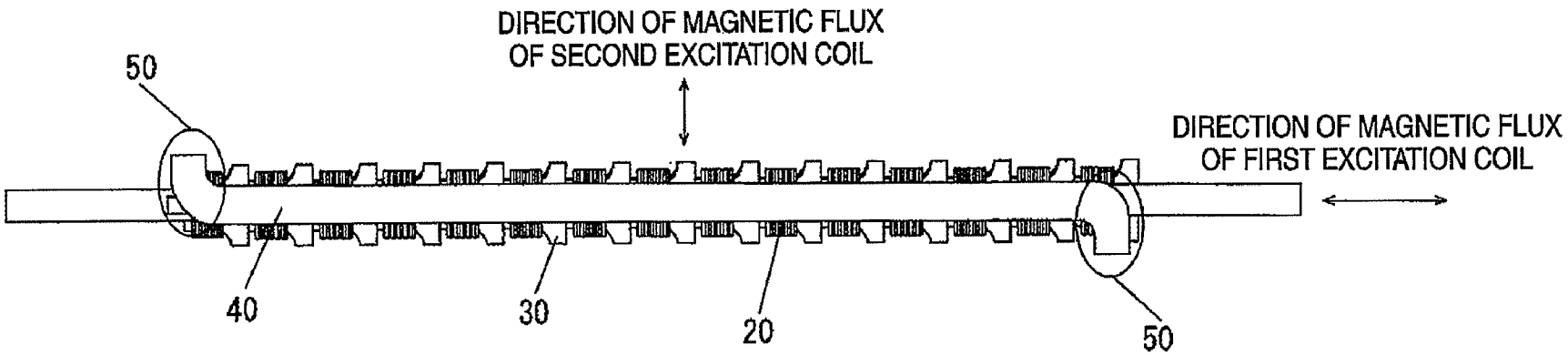
FIG. 13 is a side view of a coil unit making up an induction heating device of a third embodiment of the present invention in which a second excitation coil is disposed outside of a first excitation coil.
Figure 14:
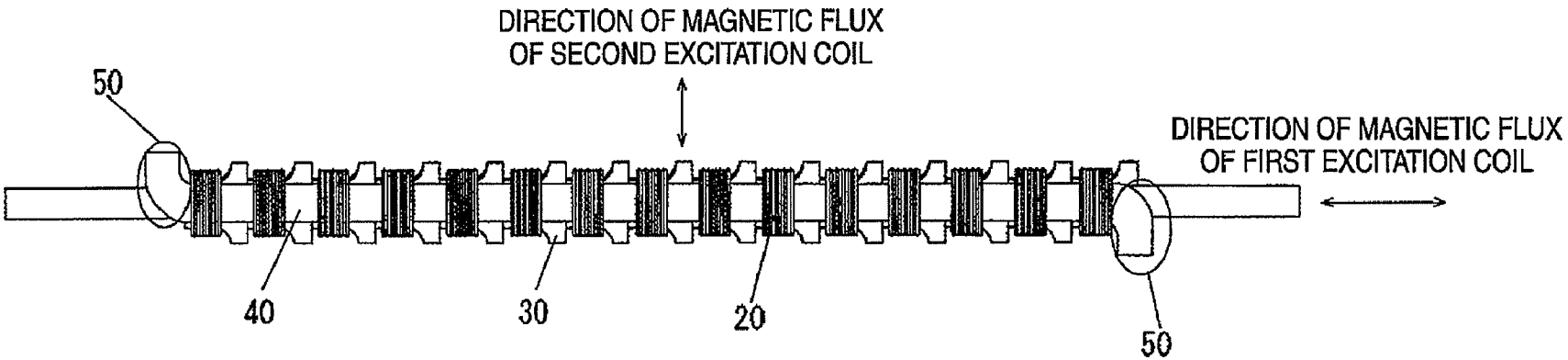
FIG. 14 is a side view of a coil unit making up an induction heating device of the third embodiment of the present invention in which the first excitation coil is disposed outside of the second excitation coil.

The positioning of the second excitation coil 40 relative to the first excitation coil 20 is not limited to the external periphery of the holding member 31 on which the ferrite cores 31 are set. The essential requirement is that the magnetic fluxes developing from the second excitation coil 40 and the magnetic fluxes developing from the first excitation coil 20 should intersect at right angles. Therefore, even when the second excitation coil 40 is provided on an internal periphery of the cylindrical holding member 31, the electromagnetic action of the coil unit remains totally unchanged. FIG. 7A is a front view that is for describing radial positions of a second excitation coil and a holding member of a coil unit which make up the induction heating device of the first embodiment of the present invention and that is achieved in a case where the second excitation coil is placed on an external periphery of the cylindrical holding member when there are used a cylindrical holding member and ferrite cores, each of which has a substantially-L-shaped cross-sectional profile. FIG. 7B is a cross-sectional view that is for describing radial positions of a second excitation coil and a holding member of a coil unit which make up the induction heating device of the first embodiment of the present invention and that is achieved in a case where the second excitation coil is placed on an external periphery of the cylindrical holding member when there are used a cylindrical holding member and ferrite cores, each of which has a substantially-L-shaped cross-sectional profile. FIG. 7C is a front view that is for describing radial positions of a second excitation coil and a holding member of a coil unit which make up the induction heating device of the first embodiment of the present invention and that is achieved in a case where the second excitation coil is placed on an internal periphery of the cylindrical holding member when there are used a cylindrical holding member and ferrite cores, each of which has a substantially-L-shaped cross-sectional profile. FIG. 7D is a cross-sectional view that is for describing radial positions of a second excitation coil and a holding member of a coil unit which make up the induction heating device of the first embodiment of the present invention and that is achieved in a case where the second excitation coil is placed on an internal periphery of the cylindrical holding member when there are used a cylindrical holding and ferrite cores, each of which has a substantially-L-shaped cross-sectional profile. An external view of the entirety of the coil unit achieved at this time is as shown in FIGS. 13 and 14. Electromagnetic action of the coil unit remains unchanged between when the coil is provided on the external periphery and when the coil is provided on the internal periphery. When the second excitation coil 40 is placed on the internal periphery of the holding member 31, there is yielded an advantage of the heating roller 10 becoming compact. In contrast, when the second excitation coil 40 is placed on the external periphery of the holding member 31, there is yielded an advantage of winding becoming simple and manufacture of a coil unit becoming easy.

When the number of ferrite cores 30 to be arranged on the holding member 31 is increased, a plurality of bent portions radially protrude from the bases. Magnetic fluxes, at high density, flow into and exit from the heating roller body 10*a* by way of the radial projections. Hence, the temperature distribution of the heating roller 10 can readily be made uniform, so that a time that elapses from when the rotation of the heating roller 10 is started until when the heating roller shifts to a state where the temperature distribution becomes uniform can be shortened.

Subsequently, a detailed structure of the bridge areas of the second excitation coil 40 of the first embodiment; namely, a detailed structure of folded areas at respective ends of the coil where the winding direction is greatly changed, will further be described. FIG. 8A is a partially-broken external view of the second excitation coil making up the induction heating device of the first embodiment of the present invention, and FIG. 8B is a partially-broken external view of the second excitation coil making up the induction heating device of the first embodiment of the present invention provided with additional coils that are equal in diameter to the bridge areas of the second excitation coil. As shown in FIG. 8A, the second excitation coil 40 is provided with parallel portions 43 along which an electric current flows in opposite directions along the axial direction of the heating roller body 10*a*. The first bridge area 41 and the second bridge area 42 are provided at respective ends of the parallel portions 43. The first bridge area 41 and the second bridge area 42 extend across the respective ends of the parallel portions 43 from one side to the other side; each assume a substantially-semicircular arc; and are bent at the right and left ends in vertically opposite directions (i.e., in circular-arc directions of the present invention).

As mentioned above, the parallel portions 43 are provided between the first bridge area 41 and the second bridge area 42 of the second excitation coil 40. When the shape of the first bridge area 41 and the shape of the second bridge area 42 are viewed in an axial direction, two circular arcs of substantially-semicircular shapes make up one circle (a closed curve). Accordingly, the magnetic fluxes that cannot have been utilized at the bridge areas in the relate art are utilized most effectively by the structure (a circle is a curve that covers the largest area by means of a predetermined line segment), whereby energy which will wastefully be consumed can be recovered. In the meantime, when axial magnetic fluxes are generated by the first bridge area 41 and the second bridge area 42, the magnetic fluxes are superimposed on the principal magnetic field generated by the second excitation coil 40. The magnetic fluxes generated by the first bridge area 41 and the second bridge area 42 hinder occurrence of a drop in the temperature, which would otherwise arise in the neighborhoods of the axial ends of the heating roller 10. The leakage fluxes in the first bridge area 41 and the second bridge area 42, which have hitherto not contributed to heating, can be recovered by shaping the second excitation coil 40, so that improvements in energy efficiency are achieved. The locations of the folded areas are not limited to the right and left ends. Any areas can be caused to protrude to surroundings and folded at arbitrary locations, so long as a calorific value of the heating roller 10 is deficient in the areas.

As shown in FIG. 8A, it is also possible to hinder occurrence of a temperature drop by means of only the first bridge area 41 and the second bridge area 42. However, when the temperature drop still continuously occurs in the ends, it is better to place additional coils 44 and 45, which are identical in diameter to the first bridge area 41 and the second bridge area 42, at respective positions that are outside of the first bridge area 41 and the second bridge area 42 in the axial direction, as shown in FIG. 8B. As a result, the number of windings of the first bridge area 41 and those of the second bridge area 42 become larger than the number of windings of the parallel portions 43 by amounts corresponding to the number of windings of the additional coils 44 and 45, whereby magnetic fluxes developing from these areas can be increased. Various methods for winding the additional coils 44 and 45 are conceivable. However, it is first better to wind the parallel portions 43, the first bridge area 41, and the second bridge area 42 and subsequently to wind coils a required number of turns at both ends. Providing the additional coils 44 and 45 makes it possible to reliably decrease the temperature drop at the ends.

A relationship regarding a structure and operation between the first bridge area 41 and the second bridge area 42 of the second excitation coil 40 is now described in detail in connection with a drive circuit for performing electromagnetic induction heating.

As shown in FIGS. 7A, 7B, 7C, and 7D, the second excitation coil 40 is wound in a direction substantially orthogonal to the direction of the axis of the first excitation coil 20. As a matter of course, the shaft of the heating roller 10 is taken as a reference. Accordingly, the magnetic fluxes developing from the first excitation coil 20 and the magnetic fluxes developing from the second excitation coil 40 intersect at right angles. If two coils are positioned side by side rather than being positioned so as to intersect at right angles and if an electric current is applied to one of the two coils, electromotive force will occur in the other coil by means of electromagnetic mutual induction. Specifically, when the magnetic fluxes of the first excitation coil 20 and the magnetic fluxes of the second excitation coil 40 do not intersect at right angles, the coils are electromagnetically coupled together by means of electromagnetic mutual induction. Heating arises also in the coils themselves, so that the calorific value of the heating roller 10 becomes deficient. Control also becomes difficult. For these reasons, in the induction heating device of the first embodiment, the coil of the first bridge area 41 and the coil of the second bridge area 42 are turned in directions in which the coils intersect substantially at right angles, to thus make the magnetic circuit of the first excitation coil 20 and the magnetic circuit of the second excitation coil 40 independent of each other; nevertheless, the calorific values are superposed on each other, to thus compensate for the deficiency.

Moreover, in the first embodiment, the first excitation coil 20 and the second excitation coil 40 are wound so as to intersect substantially at the right angles. As shown in FIG. 5, the first excitation coil 20 and the capacitor connected in parallel thereto make up an LC resonance circuit. The second excitation coil 40 and the capacitor connected in parallel thereto also make up an LC resonance circuit. Thus, the LC resonance circuits are switched respectively by independent drive circuits. When rapid warm-up is required, the first excitation coil 20 and the second excitation coil 40 respectively heat the heating roller 10 by means of a high frequency current, so that the heating roller 10 can increase a temperature by means of heating action that is a sum total of heats generated by both coils.

However, mere intersection of the coils at substantial right angles do no induce sufficient magnetic fields in the first bridge area 41 and the second bridge area 42 of the second excitation coil 40, and hence a temperature falls.

In contrast, in the induction heating device of the first embodiment, the first bridge area 41 and the second bridge area 42 are built into two semicircular arcs. When the two semicircular arcs are viewed in the axial direction, the arcs on the whole make up a single annular ring. Therefore, magnetic fluxes occur in the surroundings of the first bridge area 41 and the second bridge area 42, and the thus-developed magnetic fluxes are superposed on the magnetic field generated by the first excitation coil 20. Occurrence of a temperature drop, which would otherwise arise in the neighborhoods of the axial ends of the heating roller 10, can be prevented.

Figure 9:
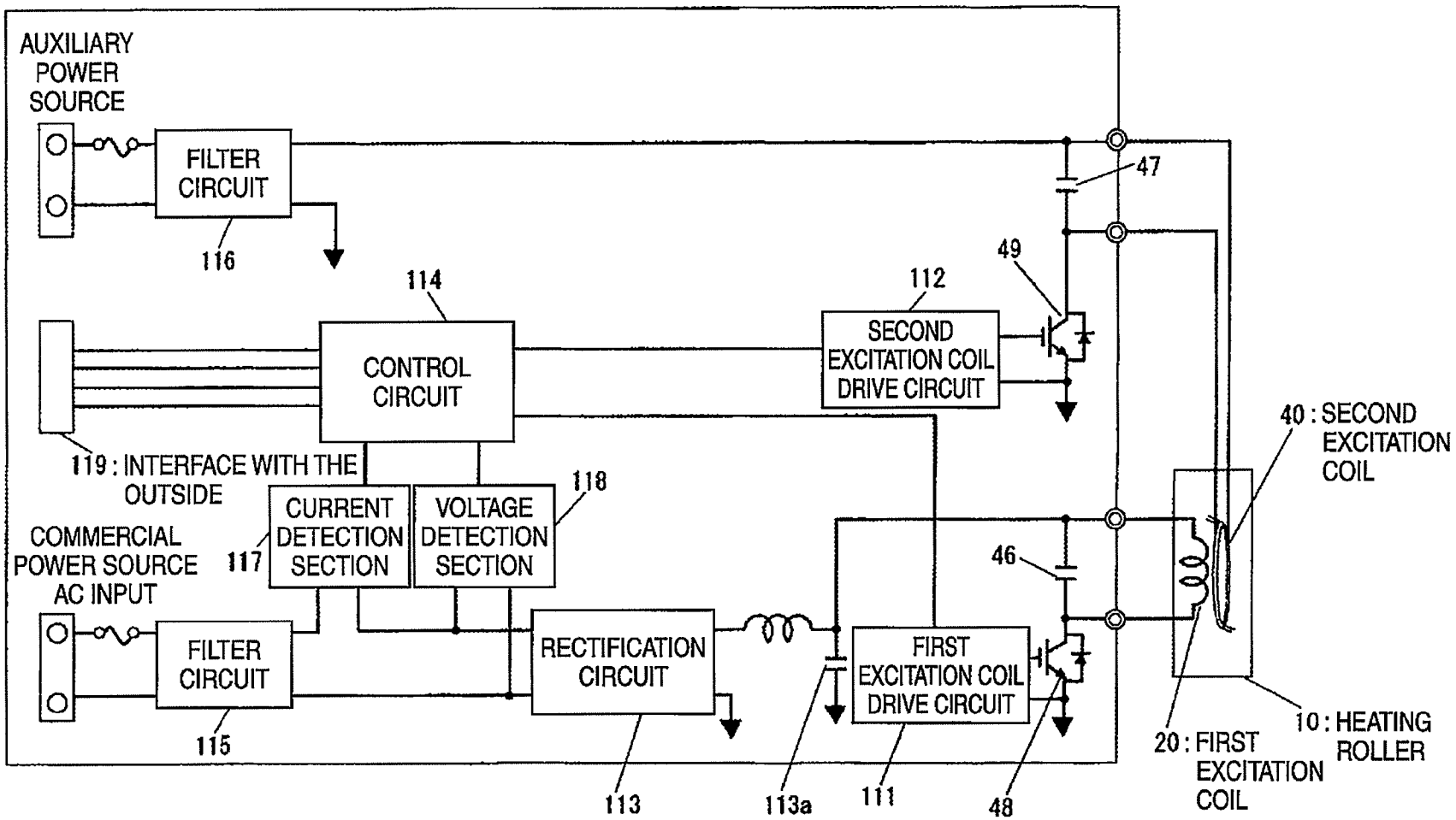
FIG. 9 is a basic circuit diagram of the coil unit making up the induction heating device of the first embodiment of the present invention.

FIG. 9 is a basic circuit diagram of the coil unit making up the induction heating device of the first embodiment of the present invention. The commercial power source is rectified by means of a filter circuit 113*a* built from a rectification circuit 113, a choke coil, and a smoothing capacitor, and the thus-rectified power is supplied as a drive power source for the LC resonance circuit made up of the first excitation coil 20 and a capacitor 46. A frequency of a high frequency power source is determined by inductance L of the first excitation coil 20 and capacitance C of the capacitor 46.

A high frequency current of the drive power source is subjected to duty control as a result of a first excitation coil drive circuit 111 turning on or off the switching element 48 by means of a signal from a control circuit 114. When the switching element 48 is turned on, an electric current flows into the first excitation coil 20, and the electric current gradually increases by virtue of the inductance L. The capacitor 46 is charged with electric charges. When the switching element 48 is turned off, the electric current in the first excitation coil 20 decreases, whereupon the electric charges in the capacitor 46 are discharged.

When the electric current flows in an opposite direction in the first excitation coil 20, the electric current flows into a diode connected in parallel to the switching element 48, the switching element thus returns to its initial state. When the switching element 48 is turned on, an electric current again flows into the first excitation coil 20, and the above operation cycle is repeated. Therefore, given that the inductance of the first excitation coil 20 is taken as L and that the capacitance of the capacitor 46 is taken as C, a high frequency current developing in the LC resonance circuit is determined by LC. When the duration of an ON period of the switching element 48 becomes longer, the quantity of supply power also increases. The duty (the ON period) of the switching element 48 may also change, and operating frequencies of the two LC resonance circuits may also change. When the electric current is not caused to flow into the second excitation coil 40, the switching element 49 is turned off.

The filter circuit 115 eliminates high frequency components from the electric current of the commercial power supply, and the rectification circuit 113 rectifies the current and supplies the thus-rectified current to the first excitation coil 20. A current detection section 117 made up of a current transformer detects the current, and a voltage of the current is then detected by a voltage detection section 118 made up of a voltage conversion transformer, whereupon a control circuit 114 drives the first excitation coil drive circuit 111. The control circuit 114 accepts a control command by way of an interlace 119 with the outside.

In contrast, the auxiliary power source that is the other power source of the first embodiment is a battery, a capacitor, a DC power source, or the like. A second excitation coil drive circuit 112 subjects an electric current of the auxiliary power source to duty control by way of a filter circuit 116 in accordance with a signal from the control circuit 114, thereby turning on or off the switching element 49. Occurrence of a temperature rise in the axial ends of the heating roller 10 can be expected by means of an increase in the magnetic fluxes in the surroundings of the first bridge area 41 and the second bridge area 42.

As a result of the first embodiment of the present invention being configured as mentioned above, even when an attempt is made to supply power to the first excitation coil 20 by use of only the commercial power source, the power supply undergoes a limiting value supplied from a power line; for instance, a 15 A limitation, so that power supply of 15 A or more is impossible. However, as shown in FIGS. 3 through 9, the second excitation coil 40 as well as the first excitation coil 20 are provided, and power is supplied to the second excitation coil 40 by use of the auxiliary power source. When rapid heating is required, power exceeding 15 A can be supplied in combination with the auxiliary power source, so that the heating roller 10 can be immediately heated.

Figure 10:
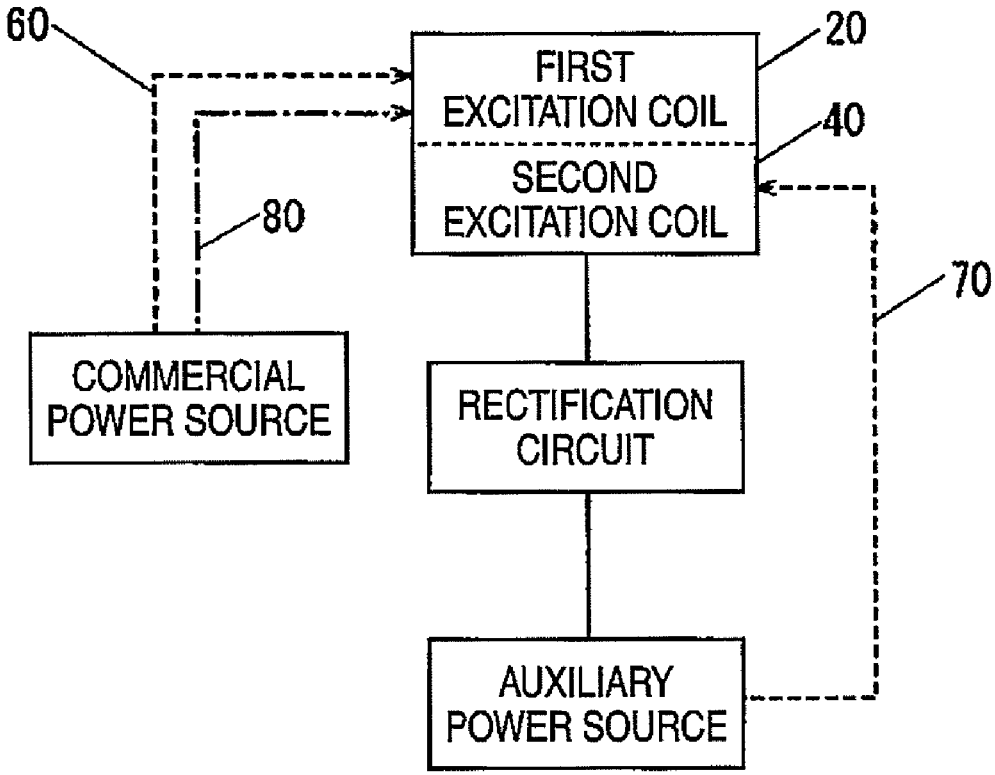
FIG. 10 is a conceptual rendering of application of power to the induction heating device of the first embodiment of the present invention.
Figure 11:
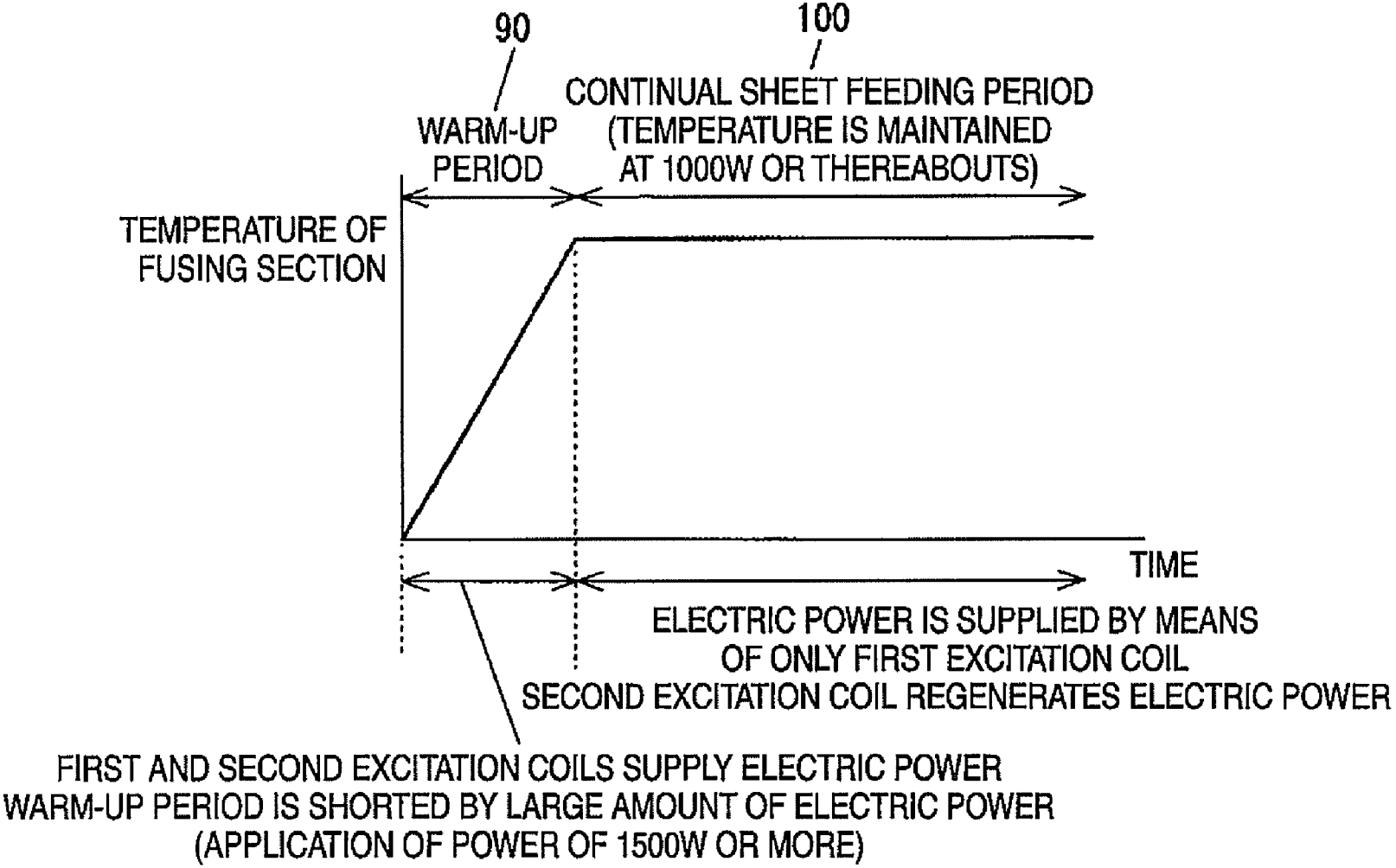
FIG. 11 is a graph showing a power control pattern of the induction heating device of the first embodiment of the present invention.

FIG. 10 is a conceptual rendering of application of power to the induction heating device of the first embodiment of the present invention. FIG. 11 is a graph showing a power control pattern of the induction heating device of the first embodiment of the present invention.

As can be seen from a warm-up period 90 shown in FIG. 11, when rapid warm-up of the heating roller 10 is required as in the case of start of fixing operation, startup, and the like, the induction heating device of the first embodiment of the present invention supplies power from the commercial power source to the first excitation coil 20 as indicated by an arrow 60 shown in FIG. 10, and also supplies electric power to the second excitation coil 40 from the auxiliary power source as indicated by an arrow 70, whereby the heating roller 10 can rapidly be heated by means of a large amount of electric power exceeding 15 A. Moreover, by means of a mere change of the structure of the two bridge areas, it becomes possible to utilize leakage fluxes of the two bridge areas that have not contributed to heating in the related art; therefore, the temperature distribution of the axial ends of the heating roller 10 is improved.

Figure 7:
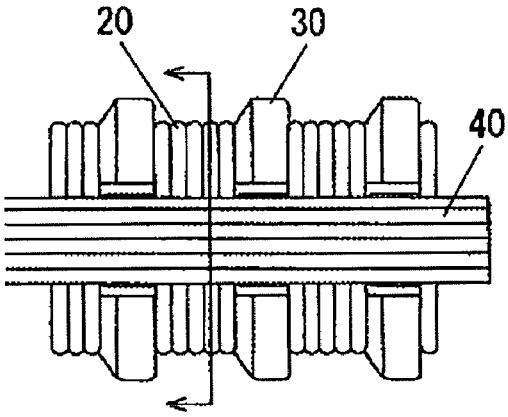
FIG. 7A is a front view that is for describing radial positions of a second excitation coil and a holding member of a coil unit which make up the induction heating device of the first embodiment of the present invention and that is achieved in a case where the second excitation coil is placed on an external periphery of the cylindrical holding member when there are used a cylindrical holding member and ferrite cores, each of which has a substantially-L-shaped cross-sectional profile.
FIG. 7B is a cross-sectional view that is for describing radial positions of a second excitation coil and a holding member of a coil unit which make up the induction heating device of the first embodiment of the present invention and that is achieved in a case where the second excitation coil is placed on an external periphery of the cylindrical holding member when there are used a cylindrical holding member and ferrite cores, each of which has a substantially-L-shaped cross-sectional profile.
FIG. 7C is a front view that is for describing radial positions of a second excitation coil and a holding member of a coil unit which make up the induction heating device of the first embodiment of the present invention and that is achieved in a case where the second excitation coil is placed on an internal periphery of the cylindrical holding member when there are used a cylindrical holding member and ferrite cores, each of which has a substantially-L-shaped cross-sectional profile.
FIG. 7D is a cross-sectional view that is for describing radial positions of a second excitation coil and a holding member of a coil unit which make up the induction heating device of the first embodiment of the present invention and that is achieved in a case where the second excitation coil is placed on an internal periphery of the cylindrical holding member when there are used a cylindrical holding member and ferrite cores, each of which has a substantially-L-shaped cross-sectional profile.
Figure 7:
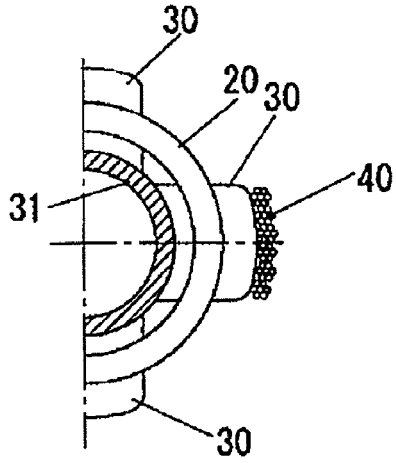
Figure 7:
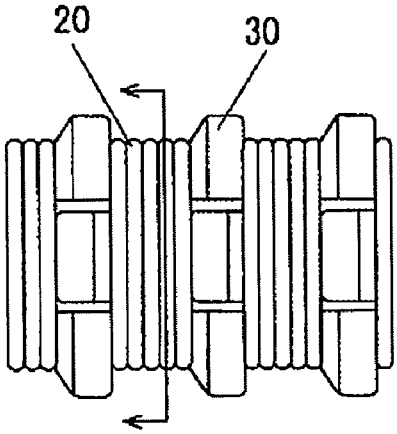
Figure 7:
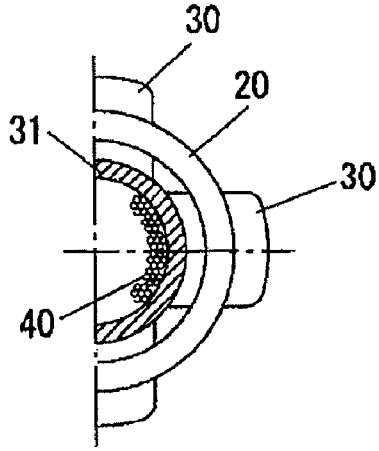
Figure 8:
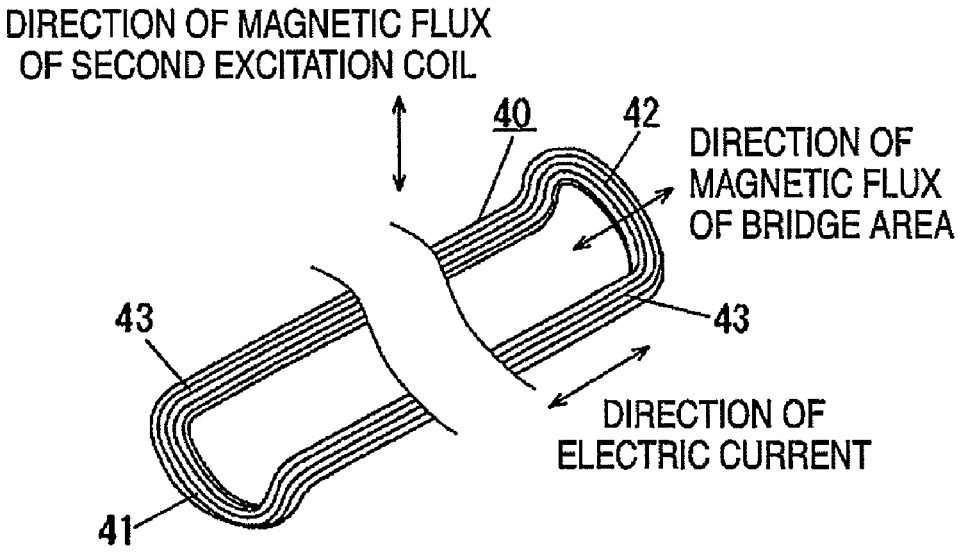
FIG. 8A is a partially-broken external view of the second excitation coil making up the induction heating device of the first embodiment of the present invention.
FIG. 8B is a partially-broken external view of the second excitation coil making up the induction heating device of the first embodiment of the present invention provided with additional coils that are equal in diameter to the bridge areas of the second excitation coil.
Figure 8:
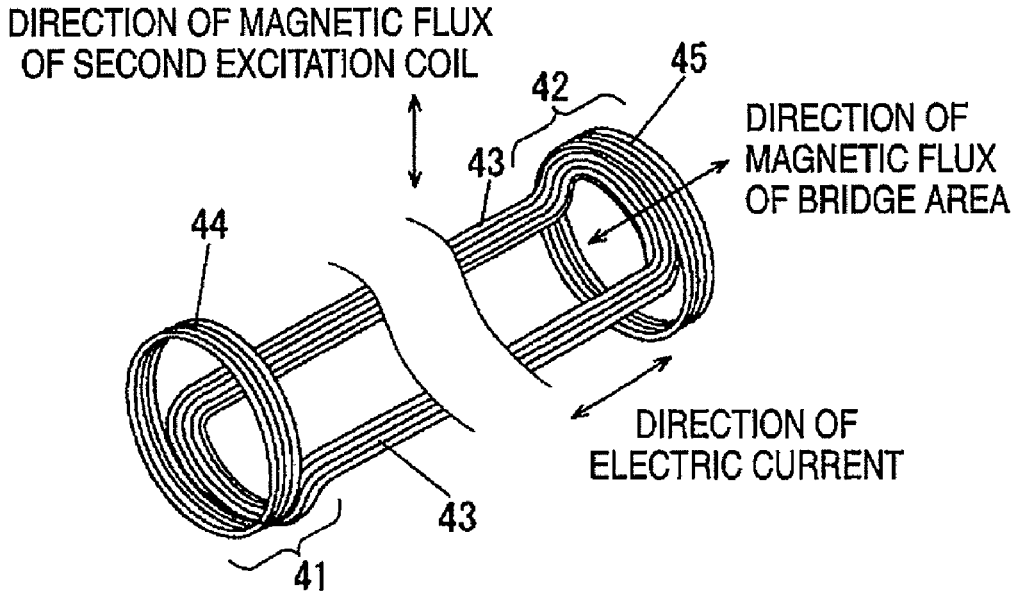

The induction heating device of the first embodiment supplies electric power from the commercial power source to the first excitation coil 20 as indicated by an arrow 80 shown in FIG. 10 after a required temperature has been attained as in a continual sheet feeding period 100 shown in FIG. 7, and the fixing temperature can be maintained while the power supply from the auxiliary power source is stopped.

Second Embodiment

An induction heating device of a second embodiment of the present invention is an induction heating device utilizing, as an auxiliary power source, a commercial power source for which a rectification circuit is employed. Although the induction heating device of the first embodiment utilizes, as the auxiliary power source, a battery, a capacitor, a DC power source, and the like, a commercial power source is utilized as an auxiliary power source in the present embodiment. Since the second embodiment coincides with the first embodiment in terms of the basic configuration, a reference is made to FIGS. 1 through 11 in the second embodiment too.

Figure 12:
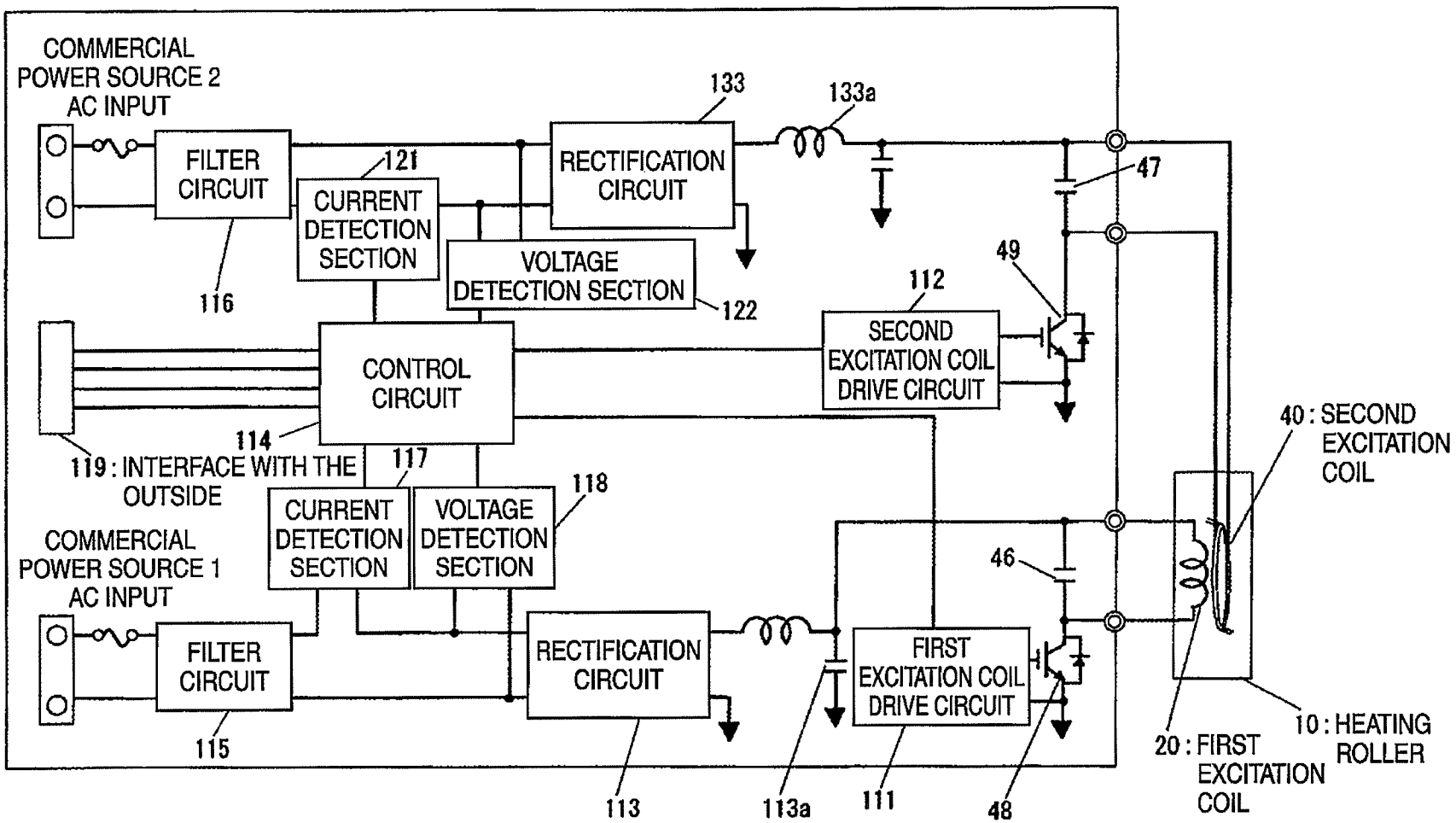
FIG. 12 is a schematic diagram of a circuit that drives a coil unit making up an induction heating device of the second embodiment of the present invention while also taking a commercial power source even for an auxiliary power source.

FIG. 12 is a schematic diagram of a circuit that drives a coil unit making up an induction heating device of the second embodiment of the present invention while also taking a commercial power source even for an auxiliary power source. The rectification circuit 113 and the filter circuit 113*a* rectify the first commercial power source, and the thus-rectified power is supplied as a drive source for the LC resonance circuit built from the first excitation coil 20 and the capacitor 46. The frequency of the high frequency power source is determined by inductance L of the second excitation coil 40 and capacitance C of the capacitor 46.

A high frequency current of the drive power source is subjected to duty control as a result of the first excitation coil drive circuit 111 turning on or off the switching element 48 in accordance with a signal from the control circuit 114. The filter circuit 115 eliminates high frequency components from the first commercial power source, and the power is supplied to the first excitation coil 20 after having been rectified by the rectification circuit 113 and the filter circuit 113*a*. The current detection section 117 made up of a current transformer detects the current, and a voltage of the current is then detected by the voltage detection section 118 made up of a voltage conversion transformer, whereupon the control circuit 114 drives the first excitation coil drive circuit 111. This is the same as that described in connection with the first embodiment. The control circuit 114 accepts a control command by way of the interface 119 with the outside.

In contrast with the first embodiment, the second embodiment utilizes a commercial power source even for an auxiliary power source. A second commercial power source is rectified by a rectification circuit 133 and a filter circuit 133*a*, and the thus-rectified power is supplied as a drive source for the LC resonance circuit built from the second excitation coil 40 and the capacitor 47. A high frequency current of the drive power source is subjected to duty control as a result of the second excitation coil drive circuit 112 turning on or off the switching element 49 in accordance with the signal from the control circuit 114. The filter circuit 116 eliminates high frequency components from the second commercial power source, and the power is supplied to the second excitation coil 40 after having been rectified by the rectification circuit 133 and the filter circuit 133*a*. The current detection section 121 made up of a current transformer detects the current, and a voltage of the current is then detected by the voltage detection section 122 made up of a voltage conversion transformer, whereupon the control circuit 114 drives the second excitation coil drive circuit 112. The control circuit 114 accepts a control command by way of the interface 119 with the outside.

As a result of the induction heating device of the second embodiment of the present invention being configured as mentioned above, the heating roller 10 can immediately be heated by use of only the commercial power source. Moreover, by means of a mere change of the structure of the two bridge areas, it becomes possible to utilize leakage fluxes of the two bridge areas that have not contributed to heating in the related art; therefore, the temperature distribution of the axial ends of the heating roller 10 is improved. Further, when the second commercial power is utilized as an auxiliary power source, a rechargeable battery is temporarily charged with an output from the rectification circuit 133, and the thus-charged power source can be utilized as an auxiliary power source in another occasion. As a result, when rapid heating is required, power exceeding 15 A can be supplied in combination with an auxiliary power source without undergoing a limited value supplied from the power line; for instance, a 15 A limitation, so that the heating roller 10 can rapidly be heated.

Third Embodiment

Next, an induction heating device of a third embodiment of the present invention regenerates leakage fluxes by mere change of the structure of the two bridge areas of the second excitation coil by utilization of electromagnetic coupling between the first excitation coil and the second excitation coil, and utilizes the thus-regenerated power as an auxiliary power source. Since the third embodiment also coincides with the first embodiment in terms of the basic configuration, a reference is made to FIGS. 1 through 11 in the third embodiment too.

Figure 15:
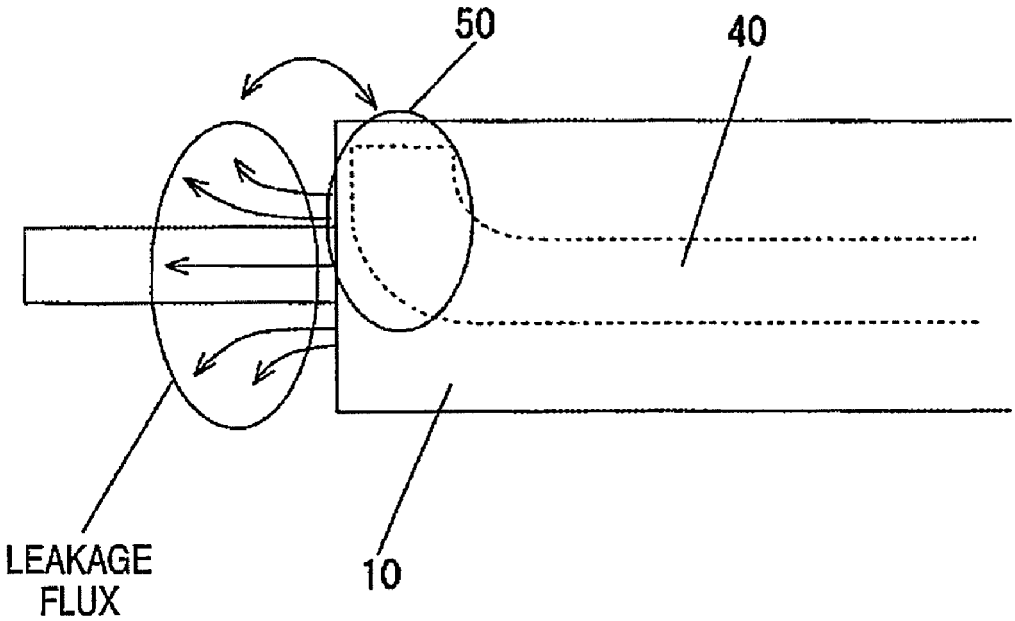
FIG. 15 is a principle chart for regenerating electric power in the induction heating device of the third embodiment of the present invention.

FIG. 13 is a side view of a coil unit making up an induction heating device of a third embodiment of the present invention in which a second excitation coil is disposed outside of a first excitation coil. FIG. 14 is a side view of a coil unit making up an induction heating device of the third embodiment of the present invention in which the first excitation coil is disposed outside of the second excitation coil. FIG. 15 is a principle chart for regenerating electric power in the induction heating device of the third embodiment of the present invention. In FIGS. 13 and 14, reference numeral 50 designates joints for electromagnetically coupling the bridge area 41 to the bridge area 42 of the first excitation coil 20 and the second excitation coil 40. The joints correspond to coil portions located at positions where the first excitation coil 20 extends in parallel to the first bridge area 41 and the second bridge area 42. When the first excitation coil 20 is connected to the commercial power source and when application of power to the second excitation coil 40 is stopped, the first excitation coil 20 and the second excitation coil 40 are electromagnetically coupled together at joints 50 located at the right and left ends of the second excitation coil 40. A side view achieved when the second excitation coil is disposed outside of the first excitation coil is as illustrated in FIG. 13, and the principal section of the layout is as shown in FIGS. 7A and 7B. A side view achieved when the first excitation coil is disposed outside of the second excitation coil is as illustrated in FIG. 14, and the principal section of the layout is as shown in FIGS. 7C and 7D. Locations of the joints 50 are not limited to the left end and the right end and can be placed at arbitrary axial positions, so long as the positions are deficient in a heat value.

In FIG. 11, a high frequency current for excitation purpose is not caused to flow to the second excitation coil 40 in the continual sheet feeding period 100 during which no power is supplied from the auxiliary power source. The high frequency current flowing through the first excitation coil 20 induces electromotive force in the second excitation coil 40 by means of electromagnetic mutual induction. Thus, electric power, which has not hitherto been utilized, is regenerated, and the rechargeable battery (an auxiliary power source) can be recharged with the thus-regenerated power. The configuration made up of the first bridge area 41 and the second bridge area 42 for recovering leakage fluxes of the second excitation coil 40 doubles as a configuration for regenerating electric power.

As shown in FIGS. 8A and 8B, the second excitation coil 40 is provided with the parallel portions 43 through which electric currents flow in opposite directions along the axial direction of the heating roller body 10*a*, and the first bridge area 41 and the second bridge area 42 connecting the respective ends of the parallel portions 43. The first bridge area 41 and the second bridge area 42 of the second excitation coil 40 are provided at respective ends of the parallel portions 43; respectively assume a substantially-semicircular shape; and are respectively folded into circular-arc shapes oriented in vertically opposite directions.

Thus, the parallel portions 43 are provided between the first bridge area 41 and the second bridge area 42 of the second excitation coil 40. The first bridge area 41 and the second bridge area 42 assume shapes of two semicircular circular arcs, and the circular arcs make a single circle (a closed curve). Accordingly, axial magnetic fluxes are generated around the first bridge area 41 and the second bridge area 42. Magnetic fluxes in bridge areas that cannot have been utilized in the related art are most effectively utilized by the configuration, so that energy can be recovered.

Figure 16:
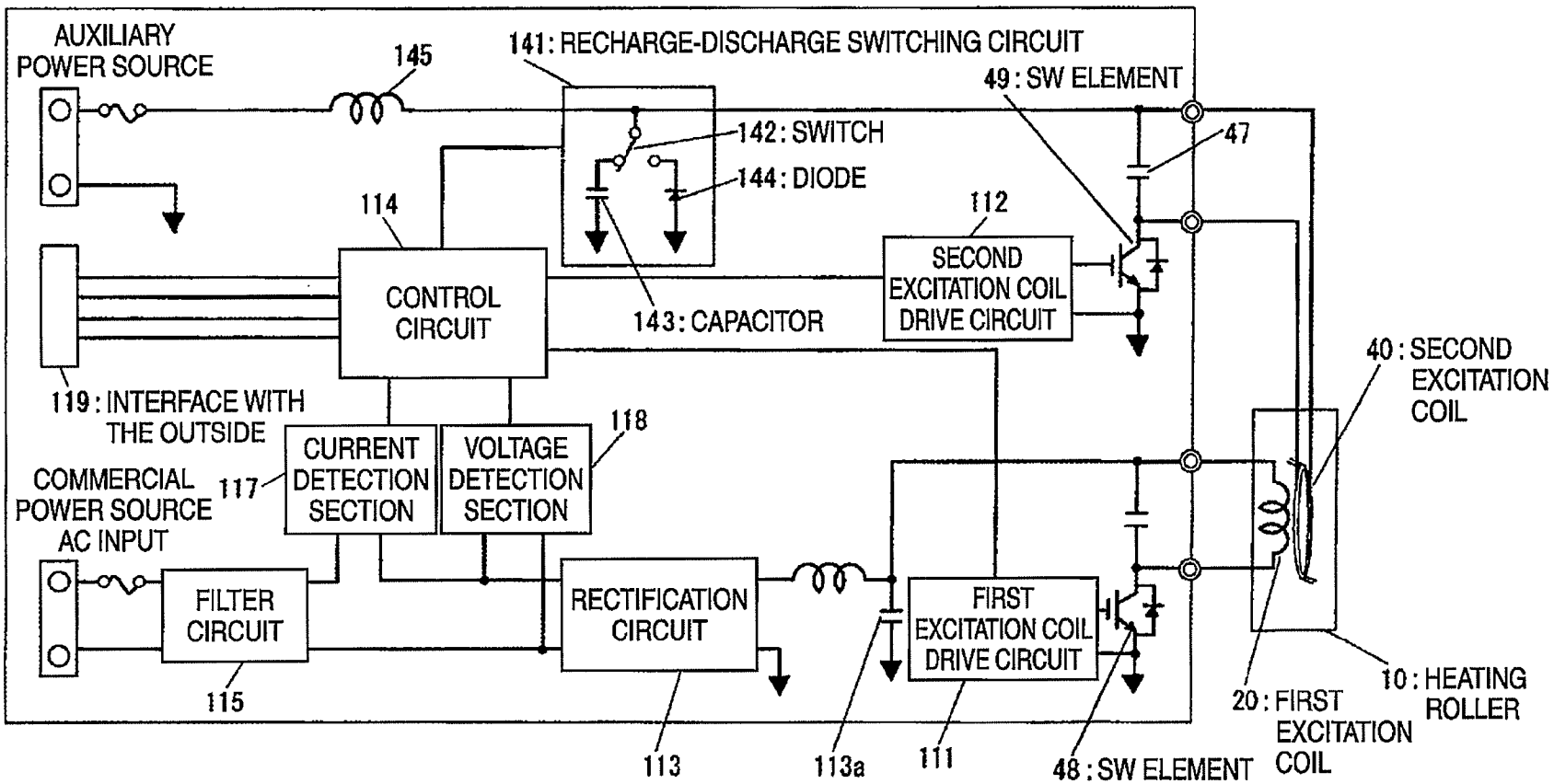
FIG. 16 is a schematic diagram of circuitry achieved when the coil unit making up the induction heating device of the third embodiment of the present invention has joints for regeneration purpose.

FIG. 16 is a schematic diagram of circuitry achieved when the coil unit making up the induction heating device of the third embodiment of the present invention has joints for regeneration purpose. The drive circuit in FIG. 16 for driving the first excitation coil 20 is analogous to its counterpart described in connection with the first embodiment. The commercial power source is rectified by means of the rectification circuit 113 and the filter circuit 113*a* built from a choke coil and a smoothing capacitor. The thus-rectified power is supplied as a drive power source to the LC resonance circuit made up of the first excitation coil 20 and the capacitor 46.

A high frequency current of the drive source is subjected to duty control as a result of the first excitation coil drive circuit 111 turning on or off the switching element 48 in accordance with the signal from the control circuit 114. The filter circuit 115 eliminates high frequency components from an electric current of the commercial power source, and the power is supplied to the first excitation coil 20 after having been rectified by the rectification circuit 113 and the filter circuit 113*a*. The current detection section 117 made up of a current transformer detects the current, and a voltage of the current is then detected by the voltage detection section 118 made up of a voltage conversion transformer, whereupon the control circuit 114 drives the first excitation coil drive circuit 111. The control circuit 114 accepts a control command by way of the interface 119 with the outside.

When rapid heating is required, an electric current is also discharged from the rechargeable battery (the auxiliary power source) so as to flow into the second excitation coil 40, whereby power exceeding a limited value supplied from the power line; for instance, a 15 A limitation, can be supplied by combination of the commercial power source with the auxiliary power source.

In FIG. 16, the control circuit 114 changes a switch 142 of a recharge-discharge switching circuit 141 to a capacitor 143 during discharging operation. As a result, high frequency components of the rechargeable battery (the auxiliary power source) are eliminated by a filter circuit made up of a coil 145 and the capacitor 143. The power is supplied to a resonance circuit made up of the first excitation coil 20 and the capacitor 46. A high frequency current is supplied to the first excitation coil 20 by turning on or off the switching element 49 connected to the second excitation coil drive circuit 112.

However, in addition to heating action being achieved by means of electric discharge of the second excitation coil 40 of the third embodiment, the rechargeable battery (the auxiliary power source) can be recharged with power from the joints 50 by utilization of the coil. The continual sheet feeding period 100 is taken as the recharging period. So long as the recharge-discharge switching circuit 141 is changed to the diode side when the second coil drive section 112 of the second excitation coil 40 is held in an OFF position, an electric current caused by electromagnetic mutual induction is rectified, to thus be able to recharge the rechargeable battery (the auxiliary power source).

During recharging operation, the control circuit 114 changes the switch 142 of the recharge-discharge switching circuit 141 to the diode side 144. The switching element 49 keeps halting switching operation at this time, and electromotive force occurring in the second excitation coil 40 by the operation of the first excitation coil 20 is regenerated in the auxiliary power source by way of a diode belonging to the switching element 49. Electric charges discharged to the earth in the first embodiment can be utilized for recharging operation in the third embodiment. A diode 144 of the recharge-discharge switching circuit 141 is a flywheel diode for enhancing regeneration capability.

Although various rechargeable batteries are present as the rechargeable battery (the auxiliary power source), utilization of an electric double layer capacitor (not illustrated) is preferable. The electric double layer capacitor is realized by immersing carbon electrodes (the cathode and the anode) in an electrolyte including both positive and negative ions. When connected to a power source, the capacitor is recharged. When connected to a load, the capacitor causes discharging action.

When the electrodes of the electric double layer capacitor are connected to the power source, cathode ions are attracted by positive holes, and positive ions are attracted by electrodes, whereby the capacitor can be recharged. In FIG. 16, during recharging operation, the switch 142 of the recharge-discharge switching circuit 141 is changed to the diode 144, thereby connecting the coil unit (the LC resonance circuit) serving as a power source to the cathode and the anode. In a recharging state, the positive holes and the negative ions, and the electrons and the positive ions form an electric double layer of the order of angstroms. Conversely, during discharging operation, the switch 142 of the recharge-discharge switching circuit 141 is changed to the capacitor 143, thereby connecting the cathode and the anode to the coil unit (the LC resonance circuit) serving as a load. A large amount of electric power can be recharged, so long as an electric double layer capacitor is utilized as a rechargeable battery (an auxiliary power source), and the configuration of the induction heating device and the configuration of the fuser become compact.

As mentioned above, in the third embodiment, the orientations of the magnetic fluxes developing from the first excitation coil 20 and the second excitation coil 40 are intersected at right angles as shown in FIGS. 13 and 14, and the first excitation coil 20 and the second excitation coil 40 are electromagnetically coupled together by means of the joints 50 provided at the right and left ends. Hence, in the continually sheet feeding period 100 during which power is not supplied from the auxiliary power source in FIG. 11, power of the auxiliary power source can be regenerated.

As shown in FIG. 15, during the continually sheet feeding period 100, leakage fluxes of the first excitation coil 20 are caused to cross the joints 50, to thus induce a voltage by means of electromagnetic mutual induction. The voltage is rectified, to thus recharge the auxiliary power source.

Magnetic fluxes of the first bridge area 41 and the second bridge area 42 contribute to an increase in the temperature in the neighborhoods of the axial ends of the heating roller 10. At this time, in the related art, it is important to cause leakage fluxes of the two bridge areas that do not actually perform any job (do not contribute to heating) to cross a heating rotor body, which thereby improves a temperature distribution acquired at axial ends of the heating roller. There is no need to provide an additional configuration for the joints 50 for power regeneration purpose. The configuration made up of the first bridge area 41 and the second bridge area 42 for recovering leakage fluxes of the second excitation coil 40 can double as the configuration.

The induction heating device of the present invention can be utilized for a fuser for fixing a recording sheet on which a toner image is produced, an image forming apparatus having a fuser, and office equipment, or the like, including these functions.

This application is based upon and claims the benefit of priority of Japanese Patent Application No 2009-119526 filed on 2009 May 18 and Japanese Patent Application No 2009-212596 filed on 2009 Sep. 18, the contents of which are incorporated herein by reference in its entirety.

The invention claimed is:

1. An induction heating device, comprising:

a cylindrical heating roller that performs electromagnetic induction heating;

a first excitation coil that is provided inside of the heating roller, that is wound so as to have an axis extending in the same direction as a direction of a shaft of the heating roller, and that is connected to a first power source, the first power source comprising a commercial power source; and a second excitation coil that is provided inside of the heating roller, that is wound so as to have an axis in a direction substantially orthogonal to the shaft of the heating roller, and that is connected to a second power source, the second power source comprising a rechargeable auxiliary power source, wherein the second excitation coil has parallel portions that linearly extend in parallel to an axial direction of the first excitation coil and circular-arc bridge areas that extend in a direction substantially orthogonal to an axial direction of the first excitation coil so as to couple ends of the two parallel portions;

the two bridge areas are provided along a circumference of and overlapping the first excitation coil such that an open side of the circular arc of the first bridge area faces in a first direction and an open side of the circular arc of the second bridge area faces in a second direction opposite to the first direction; and a control circuit that recharges the second power source by means of the second excitation coil when electric power is supplied from the first power source to the first excitation coil and electric power is not supplied from the second power source to the second excitation coil.

2. The induction heating device according to claim 1, further comprising:

a control circuit that recovers electric power developed in the second excitation coil when electric power is supplied from the first power source to the first excitation coil and electric power is not supplied from the second power source to the second excitation coil and recycles the recovered electric power.

3. The induction heating device according to claim 1, wherein the number of windings of the bridge areas is larger than the number of windings of the parallel portions.

4. The induction heating device according to claim 1, wherein the commercial power source is connected to the second power source by way of a rectification circuit.

5. The induction heating device according to claim 1, wherein the second power source is an electric double layer capacitor.

6. An induction heating device comprising:

a cylindrical heating roller that performs electromagnetic induction heating;

a first excitation coil that is provided inside of the heating roller, that is wound so as to have an axis in the same direction as an axis of a shaft of the heating roller, and that is connected to a first power source, the first power source comprising a commercial power source; and a second excitation coil that is provided inside of the heating roller, that is wound so as to have an axis in a direction substantially orthogonal to the shaft of the heating roller, and that is connected to a second power source, the second power source comprising a rechargeable auxiliary power source, wherein the second excitation coil has parallel portions that extend in parallel to an axial direction of the first excitation coil and two bridge areas that are folded at respective ends of the parallel portions;

the two bridge areas are provided along a circumference of the first excitation coil such that an open side of a circular arc of the first bridge area faces in a first direction and an open side of a circular arc of the second bridge area faces in a second direction opposite to the first direction; and a control circuit that recharges the second power source by means of the second excitation coil when electric power is supplied from the first power source to the first excitation coil and electric power is not supplied from the second power source to the second excitation coil.

* * * * *